United States Patent [19]

Kondur, Jr.

[11] 4,381,155

[45] Apr. 26, 1983

[54] INKED RIBBON ADVANCE AND REVERSE MECHANISM

[75] Inventor: Nicholas Kondur, Jr., Westminster, Colo.

[73] Assignee: C. Itoh Electronics, Inc., Los Angeles, Calif.

[21] Appl. No.: 199,115

[22] Filed: Nov. 5, 1980

[51] Int. Cl.[3] ..... B41J 33/48; B41J 33/40

[52] U.S. Cl. ..... 400/220.1; 400/236.1

[58] Field of Search ..... 101/96, 102, 100; 400/218–220, 220.1, 220.2, 229, 236.1, 124, 149, 82

[56] References Cited

U.S. PATENT DOCUMENTS

| | | | |
|---|---|---|---|
| 3,145,651 | 8/1964 | Schultz | 400/220 X |
| 3,986,594 | 10/1976 | Kondur | 400/320 X |
| 3,997,046 | 12/1976 | Wolowitz | 400/220.2 |
| 4,214,838 | 7/1980 | Gassowski | 400/220.1 |

OTHER PUBLICATIONS

IBM Technical Disclosure Bulletin; vol. 21, #8; Jan. 1979; Pivot'g Head Multi-Station Printer, A. C. Thorpe.

*Primary Examiner*—A. J. Heinz

*Attorney, Agent, or Firm*—W. Edward Johansen

[57] ABSTRACT

The present invention is an improved inked ribbon advance and reverse mechanism for use in a multiple print station printing apparatus. The improved inked ribbon advance and reverse mechanism includes a first ribbon spool and a second ribbon spool onto and from which an inked ribbon is wound and unwound, respectively. The improved inked ribbon advance and reverse mechanism also includes a first ratchet wheel and a second ratchet wheel which are axially aligned and fixedly coupled to the first ribbon spool and the second ribbon spool, respectively, so that they rotate together. The second ratchet wheel is disposed in a vertical plane which is parallel with the axis of the rotative drive shaft of the printing apparatus and substantially orthogonal to the plane in which the first ratchet wheel is disposed, and is adjacent, but not contiguous, to the first ratchet wheel. The improved inked ribbon advance and reverse mechanism further includes a pawl which has a first tooth and a second tooth, which engage one of the teeth of the first ratchet wheel and the second ratchet wheel, respectively, a sliding member which has a first flange and a second flange, which is fixedly coupled to the pawl, and which is slidably coupled to the frame of the printing apparatus and a lever arm which is pivotally and resiliently coupled to a mounting member, which is fixedly coupled to the movable carrier of the printing apparatus. One of the ends of the lever arm contacts either the first flange or the second flange of the sliding member.

3 Claims, 13 Drawing Figures

Fig. 1.
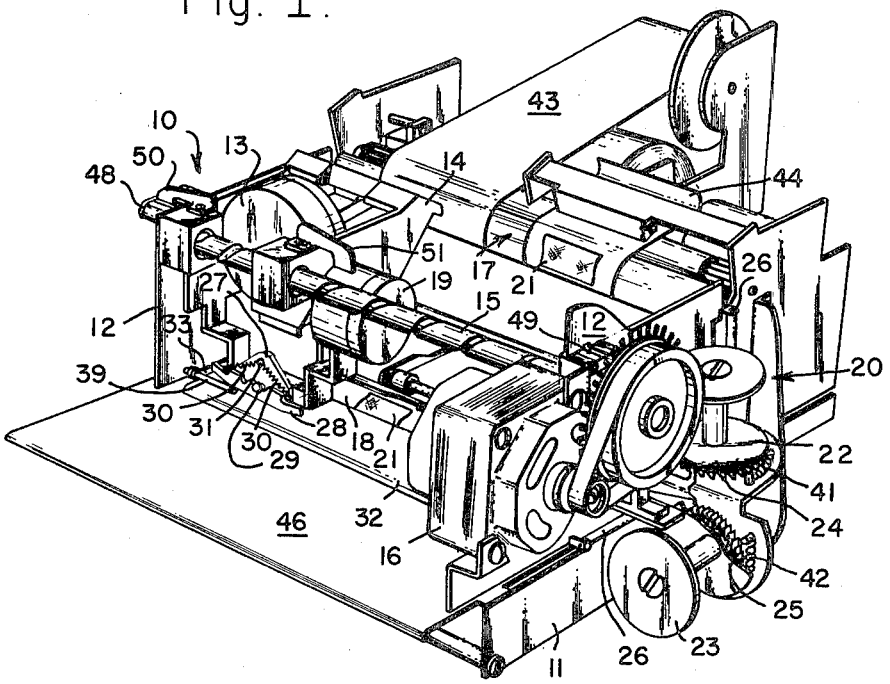
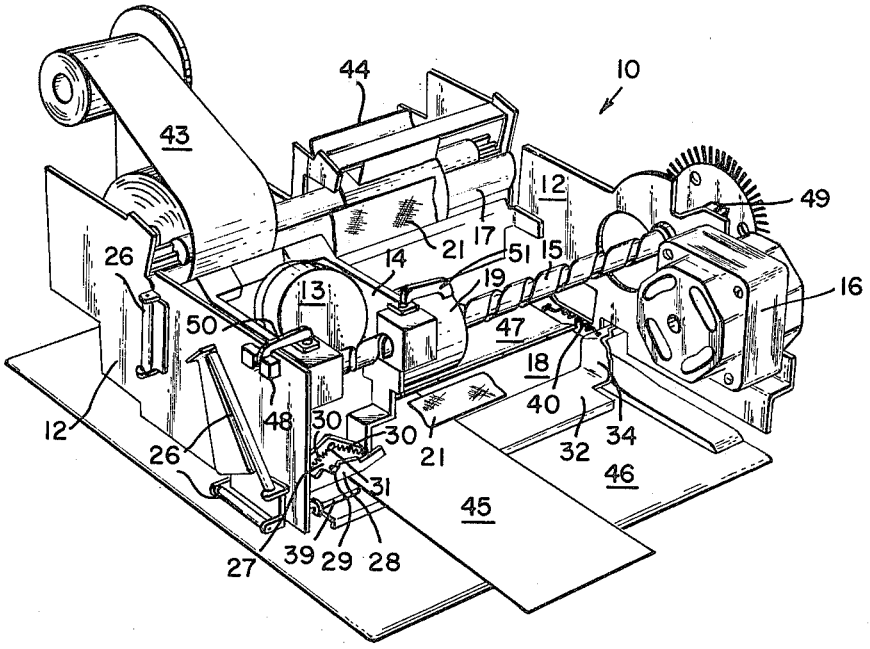
Fig. 2.

INKED RIBBON ADVANCE AND REVERSE MECHANISM

BACKGROUND OF THE INVENTION

1. Field of the Invention

The present invention relates to an inked ribbon advance and reverse mechanism for multiple print station printing apparatus having a movable carrier with a rotatable print head and more particularly to such a mechanism for advancing an inked ribbon in two planes.

2. Description of the Prior Art

U.S. Pat. No. 4,082,035, entitled High Speed Printer Having Segmented Drum, issued to Gosta Roland Englund on Apr. 4, 1978, teaches a printing apparatus for printing characters onto a print medium which includes at least one printing station, a carrier which supports a plurality of segments that are included in the characters and a device for feeding the print medium through the printing station. The carrier is arranged to move the segments in sequence through the printing station. The printing apparatus also includes an actuator for actuating the print medium when a selected one of the segments on the carrier is located in the printing station. The device for feeding is arranged to feed the print medium intermittently through the printing station and the actuator is arranged to be activated when the print medium takes its rest position. The printing apparatus is housed in a casing and has a slot, from which a printed receipt may be obtained, and a window, through which a check ribbon or a journal print medium for audit purposes can be seen. The printing apparatus has three spaced apart printing stations, one of which prints on a print medium which is orthogonally disposed to the other print media.

U.S. Pat. No. 4,027,765, entitled Record Media Drive Mechanism, issued to Leslie L. Crump and Victor J. Italiano on June 7, 1977, teaches a plurality of printing stations which are spaced across a printing apparatus wherein a feed or drive assembly for a print medium is associated with each printing station. Each of the feed or drive assemblies is self-contained and of modular construction in order to enable positioning of a particular feed or drive assembly in any desired location along a drive shaft. One feed or drive mechanism includes a clutch member and associated drive gears and rollers to incrementally advance a print medium, such as receipt paper, in one direction. A second feed or drive mechanism includes the clutch member and additional drive gears and rollers to incrementally advance a second print medium, such as journal paper in the same direction for rewinding and storage thereof in the printing apparatus. A third feed or drive mechanism includes the clutch member and further drive gears and rollers to incrementally advance a third print medium, such as slip or form paper in the opposite direction. In the modern business machine, a normal or common type of construction may include a receipt station, a journal or audit station and a slip or form station, wherein, respectively, a receipt is printed and provided to the customer, a journal or an audit is printed and retained or stored in the business machine, and a slip or form, which may be in the manner of a pass book or a document, is inserted and certain information is printed thereon and then returned to the customer, if it is a pass book, or disposited in a receptacle for further processing, if it is a check or similar document. U.S. Pat. No. 3,825,681 also discloses several printing stations which are adjacent to one another for performing these several functions. U.S. Pat. No. 4,027,765 teaches a single print head which operates across each printing station. The print medium at each of the printing stations is disposed in the same plane as the other print media.

U.S. Pat. No. 3,910,396, entitled Business Machine Printer Having Plural Print Heads, issued to Albert L. Eischen and George Kolomayeta on Oct. 7, 1975, teaches a high speed serial printing apparatus for business machines which includes a plurality of platens each of which backs an associated print medium, a continuous Mobius inked ribbon, a carriage which is movable relative to the platens and a plurality of print heads which are mounted on the carriage. Each print head has a set of selectively movable printing elements which are cooperable with the inked ribbon to impactingly print on the print medium associated with one of the platens. The print heads are mounted back to back on the carriage in opposing spatial relationship and are offset with respect to each other and the carriage so that each print head impactingly engages the Mobius loop inked ribbon along each of two parallel printing paths thereon, in order to effect substantially even ribbon wear and best inking characteristics, regardless of the relative usage of the print heads.

U.S. Pat. No. 4,167,345, entitled Printing Apparatus with Selectively Movable Printing Heads, issued to Gosta R. Englund and Karl T. Wincent on Sept. 11, 1979, teaches a printing apparatus for printing characters on at least one data carrier or print medium which includes a print head which is movable along the data carrier or print medium, a line advance device for feeding the data carrier or print medium substantially perpendicular to the moving direction of the print head, an inked ribbon feed mechanism for feeding an inked ribbon in relation to the data carrier or print medium, a cut-off mechanism for cutting off the data carrier or print medium, and a shaft which is rotatable less than 360° in one direction by a reversible motor from a home position to an end position which is determined by the selected operation cycle and thereafter back to the home position by reversing the direction of rotation of the shaft. The reversal of the shaft is performed at different times during subsequent operation cycles in order to permit gears and cams on the shaft to move the print head to positions which are determined by the number of characters to be printed on the data carrier or print medium, actuation of the line advance device and actuation of the inked ribbon feed mechanism or cut-off mechanism. A unit for printing normally unchanging information is activated in response to the motor providing a short backing movement before operation of the cut-off mechanism and before the print head is moved from the neutral position.

All of the above patents teach a plurality of print stations in most of which the print media are generally in the same plane. U.S. Pat. No. 3,910,396 teaches two printing stations in which the print media are parallelly disposed. U.S. Pat. No. 4,082,035 teaches three printing stations each of which has its own printing device and in which one of the three print media is disposed orthogonally to the other two print media. It is often more convenient to have the slip printing station disposed perpendicular to the receipt printing station, but in view of the trend toward a more compact printing apparatus and less mechanical complexity thereof the required addition of a second orthogonally disposed printing device increases both the volume and the complexity of the printing apparatus.

Whenever a multiple print station printing apparatus is used wherein at one of the print station is disposed in a different plane it often becomes necessary to have at least two inked ribbon advance and reverse mechanisms in order to advance a length of inked ribbon for each print station if the inked ribbon advance and reverse mechanism of the prior art are used. If one inked ribbon advance and reverse mechanism is used, then it will be very complicated.

U.S. Pat. No. 3,986,594, entitled Serial Impact Calculator Printer, issued to Nicholas Kondur, Jr. on Oct. 19, 1976, teaches a ribbon spool drive member which coordinates the advancement of an inked ribbon with the print head travel. U.S. Pat. No. 3,825,103, entitled High-Speed Printer Having Improved Ribbon Driving, Reversing and Tensioning Mechanism, issued to Arthur F. Riley on July 23, 1974, also teaches an inked ribbon advancement mechanism.

U.S. Pat. No. 3,880,271, entitled Ribbon Feed, issued to Terrance J. Hebron on Apr. 29, 1975, also teaches a ribbon feed for a printing apparatus.

SUMMARY OF THE INVENTION

In view of the foregoing factors and conditions characteristic of the prior art, it is the primary object of the present invention to provide an inked ribbon advance and reverse mechanism which advances a single inked ribbon for use in combination with a multiple print station printing apparatus having print stations disposed in planes which are at different angles to each other.

It is another object of the present invention to provide a pawl and lever arm combination for an inked ribbon advance and reverse mechanism which is not complicated and which has very few mechanical components.

It is still another object of the present invention to provide a pawl and lever arm combination for an inked ribbon advance and reverse mechanism which can advance an inked ribbon through a plurality of print stations at least one of which is disposed in a plane which is orthogonal to the plane of the other print stations.

In accordance with an embodiment of the present invention an improved inked ribbon advance and reverse mechanism for use in a multiple print station printing apparatus is described. The improved inked ribbon advance and reverse mechanism includes a first ribbon spool and a second ribbon spool onto and from which an inked ribbon is wound and unwound, respectively. The improved inked ribbon advance and reverse mechanism also includes a first ratchet wheel and a second ratchet wheel which are axially aligned and fixedly coupled to the first ribbon spool and the second ribbon spool, respectively, so that they rotate together. The second ratchet wheel is disposed in a vertical plane which is parallel with the axis of the rotative drive shaft of the printing apparatus and substantially orthogonal to the plane in which the first ratchet wheel is disposed, and is adjacent, but not continguous, to the first ratchet wheel. The improved inked ribbon advance and reverse mechanism further includes a pawl which has a first tooth and a second tooth, which engage one of the teeth of the first ratchet wheel and the second ratchet wheel, respectively, a sliding member which has a first flange and a second flange, which is fixedly coupled to the pawl, and which is slidably coupled to the frame of the printing apparatus and a lever arm which is pivotally and resiliently coupled to a mounting member, which is fixedly coupled to the movable carrier of the printing apparatus. One of the ends of the lever arm contacts either the first flange or the second flange of the sliding member.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a multiple print station printing apparatus which illustrates the right-hand side of an inked ribbon advance and reverse mechanism which has been constructed in accordance with the principles of the present invention.

FIG. 2 is a perspective drawing of the multiple print station printing apparatus of FIG. 1 which illustrates the left-hand side of the inked ribbon advance and reverse mechanism.

Figure 5:
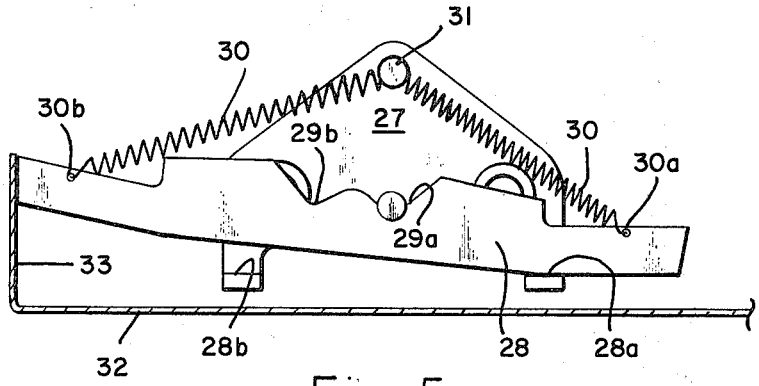
FIG. 5 is an elevational front view of a mounting member, the lever arm and a pivot pin of the inked ribbon advance and reverse mechanism of the multiple print station printing apparatus of FIG. 1 with the lever arm in its first position.

FIG. *7a* is a top plan view of the sliding member of the inked ribbon advance and reverse mechanism of the multiple print station printing apparatus of FIG. 1 when the lever arm of FIG. 5 is in its first position and the sliding member has been pushed to the left a distance, which is designated the displacement distance, by the lever arm.

FIG. *7b* is a similar top plan view as FIG. *7a* but when the sliding member has been returned to its neutral position by the lever arm.

Figure 8:
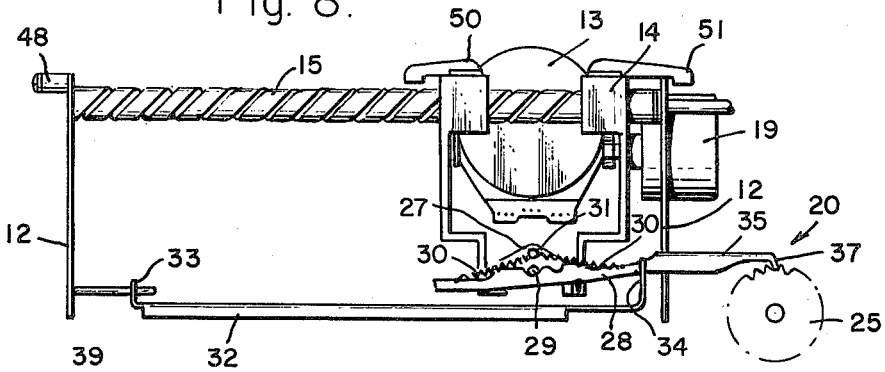

FIG. 8 is a front elevational view of the inked ribbon advance mechanism of the multiple print station printing apparatus of FIG. 1 which illustrates the lever arm of the inked ribbon advance and reverse mechanism in its second position so that a second ribbon spool is rotated clockwise and functions as a take-up spool.

Figure 9:
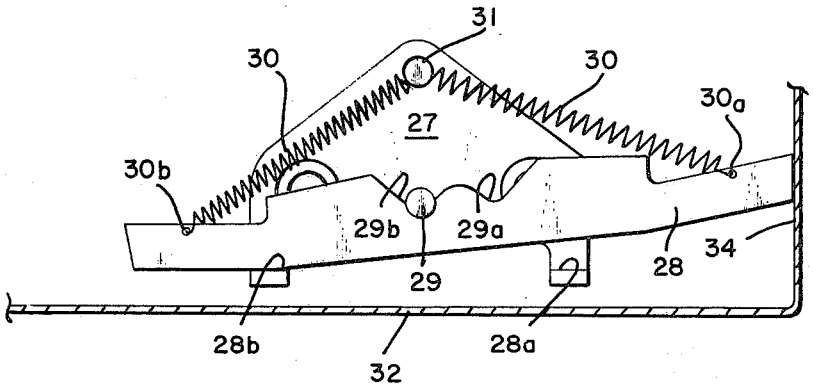

FIG. 9 is an elevational front view of the mounting member, the lever arm and the pivot pin of the inked ribbon advance and reverse mechanism of the multiple print station printing apparatus of FIG. 1 with the lever arm in its second position.

Figure 10B:
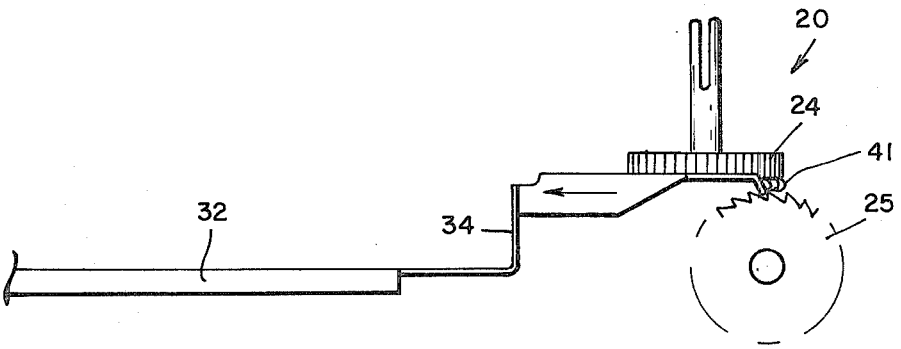
Figure 10A:
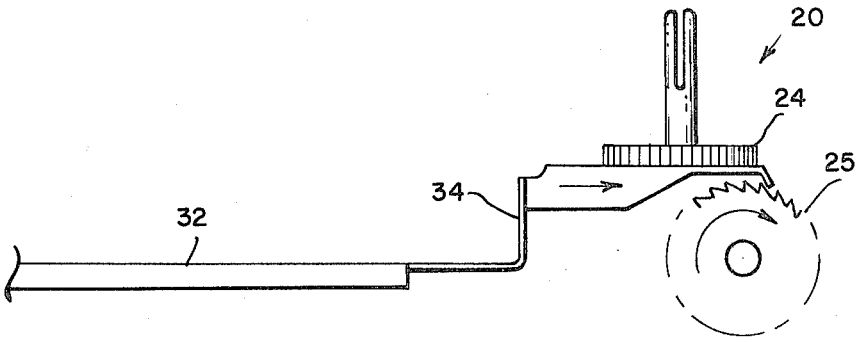

FIG. 10*a* is a side elevational view of the sliding member of the inked ribbon advance and reverse mechanism of the multiple print station printing apparatus of FIG. 1 when the lever arm of FIG. 9 is in its second position and the sliding member has been pushed to the right a distance, which is also designated the displacement distance, by the lever arm.

FIG. 10*b* is also a similar side elevational view as FIG. 10*a* but when the sliding member has been returned to its neutral position by the lever arm.

Figure 11:
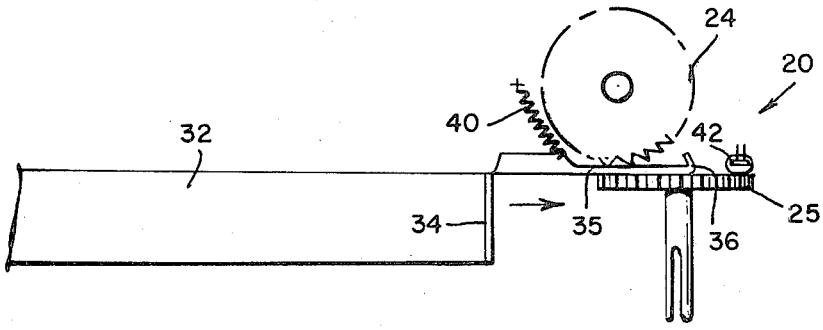
Figure 7A:
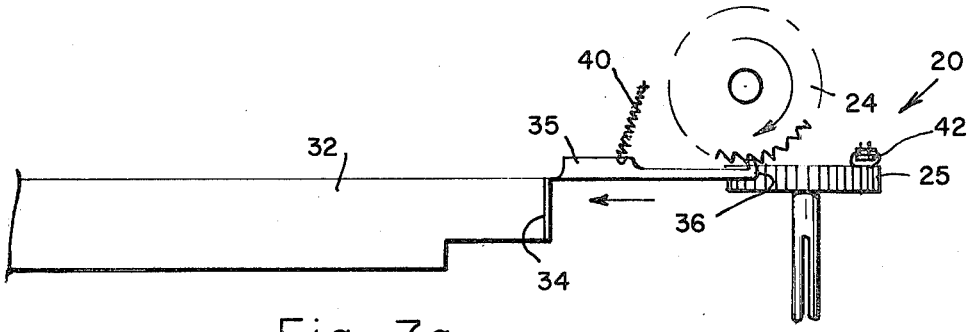

FIG. 11 is a similar top plan view as FIG. 7*a* but when the sliding member has been pushed to the right a distance, which is also designated the displacement distance, by the lever arm in its second position.

DESCRIPTION OF THE PREFERRED EMBODIMENT

In order to best understand the present invention it is necessary to refer the following detailed description of its preferred embodiment in conjunction with the accompanying drawing. Referring to FIG. 1 a multiple print station printing apparatus 10 includes a frame 11 having a pair of side plates 12 and a rotatable print head 13 which is pivotally coupled to a movable carrier 14. The printing apparatus 10 also includes a rotative drive shaft 15 which drives the movable carrier 14 and the rotatable print head 13 laterally, back and forth, across the frame 11. A first bi-directional motor 16 drives the rotative shaft 15. U.S. Pat. No. 4,167,345 and U.S. Pat. No. 4,027,765 teach similar rotative drive shafts.

In other embodiments of the present invention other mechanisms for moving the movable carrier 14 laterally, back and forth, across the frame 11 may be used in place of the rotative drive shaft 15 and the first di-directional motor 16. U.S. Pat. No. 4,203,679, entitled Print Head Control, issued to Jonathan H. Duerr and Anthony C. Twitchen on May 20, 1980, teaches one of these mechanisms. U.S. Pat. No. 4,203,680, entitled High-Speed Printer with Self-Adjusting Cable Preload Mechanism, issued to Svetislav Mitrovich on May 20, 1980, teaches another of these mechanisms which includes a cable and a bi-directional motor which are mechanically coupled to a carrier for carrying a print head in order to move the carrier and the print head laterally, back and forth, across the frame 11. In still other embodiments of the present invention the movable carrier 14 may be driven laterally, back and forth, across the frame 11 by a set of gears and a bi-directional motor.

The printing apparatus 10 further includes a first platen 17 the print surface of which is disposed in a first plane which is substantially vertical and parallel with the axis of the rotative drive shaft 15 and a second platen 18 the print surface of which is disposed in a second plane which is substantially horizontal and parallel with the axis of the rotative drive shaft 15. A second bi-directional motor 19 may rotatively drive the print head 13 from its printing alignment with the first platen 17 to its printing alignment with the second platen 18. The second bi-directional motor 19, when reversed, may rotatively drive the print head 13 from its printing alignment with the second platen 18 to its printing alignment with the first platen 17. In the preferred embodiment of the present invention the same amount of current for turning the second bi-directional motor 19 continues to be fed thereto in order to maintain the rotatable print head 13 in either its first or second printing alignment with either the first or second platen, 17 or 18, respectively. In other embodiments of the present invention a mechanical latch may be used to secure the rotatable print head 13 in its proper printing alignment with each of the respective platens 17 and 18. In still other embodiments of the present invention a set of springs may resiliently bias the print head 13 so that it is in its proper printing alignment with each of the respective platens 17 and 18.

The printing apparatus 10 also includes an inked ribbon advance and reverse mechanism 20 for advancing an inked ribbon 21. Referring now to FIG. 2 in conjunction with FIG. 1 the inked ribbon advance and reverse mechanism 20 includes a first ribbon spool 22 and a second ribbon spool 23. The inked ribbon advance and reverse mechanism 20 also includes a first ratchet wheel 24 the axis of which is vertically disposed and a second ratchet wheel 25 the axis of which is horizontally disposed in a vertical plane which is orthogonal to the axis of the rotative drive shaft 15. The plane which includes the first ratchet wheel 24 is orthogonal to the plane which includes the second ratchet wheel 25. The vertical plane which includes the axis of the second ratchet wheel 25, which is orthogonal to the axis of the rotative drive shaft 15, is adjacent to, but is spaced apart from, the vertical plane which includes the axis of the first ratchet wheel 24, which is orthogonal to the axis of the rotative drive shaft in the direction away from the frame 11. The first ribbon spool 22 is axially aligned with and fixedly coupled to the first ratchet wheel 24. The second ribbon spool 23 is axially aligned with and fixedly coupled to the second ratchet wheel 25. The inked ribbon advance and reverse mechanism 20 further includes a plurality of guide roller-pins 26 all of which are mechanically coupled to the side plates 12 of the frame 11 of the printing apparatus 10 in an appropriate arrangement for routing the inked ribbon 21 between the first and second ribbon spools 22 and 23.

Figure 3:
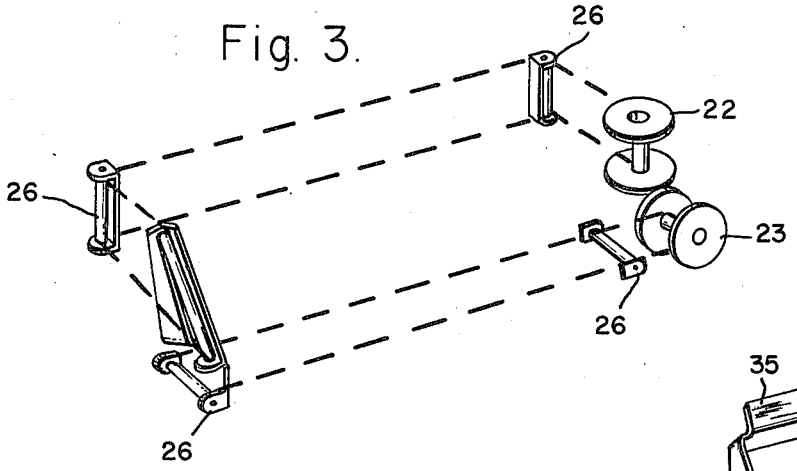
FIG. 3 is a schematic drawing of the path of the inked ribbon in the inked ribbon advance and reverse mechanism of the multiple print station printing apparatus of FIG. 1.

Referring now to FIG. 3 in conjunction with FIG. 1 and FIG. 2 the path of the inked ribbon 21 from the first ribbon spool 22 to the second ribbon spool 23 is shown as the inked ribbon 21 passes through each of the plurality of guide roller-pins 26.

Figure 4:
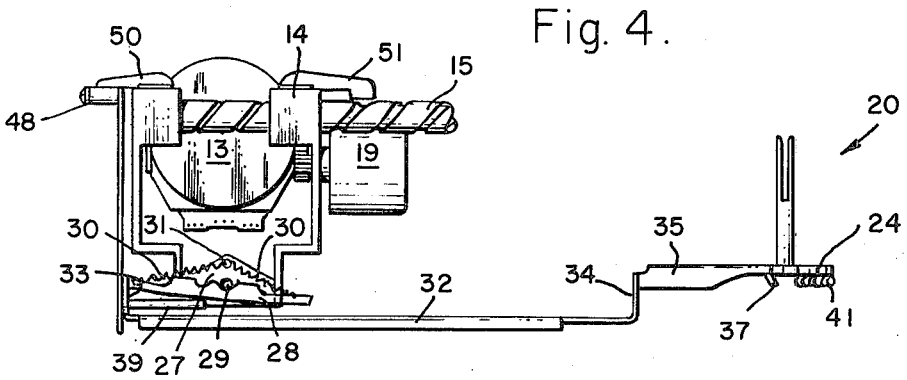
FIG. 4 is a front elevational view of the inked ribbon advance and reverse mechanism of the multiple print station printing apparatus of FIG. 1 which illustrates a lever arm of the inked ribbon advance and reverse mechanism in its first position so that a first ribbon spool is rotated clockwise and functions as a take-up spool.

Referring to FIG. 4 in conjunction with FIG. 1 and FIG. 2 the inked ribbon advance and reverse mechanism 20 still further includes a mounting member 27, which is rigidly coupled to the movable carrier 14 so that it travels with the movable carrier 14 laterally, back and forth, across the frame 11 of the printing apparatus 10, a lever arm 28 and a pivot pin 29, which is fixedly coupled to the mounting member 27 and which is disposed on the centerline of the mounting member 27 adjacent to its bottom peripheral edge. The pivot pin 29 pivotally couples the lever arm 28 to the mounting member 27. A pair of springs 30, both of which are attached to a common spring anchor pin 31 which is fixedly coupled to the mounting member 27 and which is disposed on the centerline of the mounting member 27, adjacent to its top peripheral edge, resiliently couples the lever arm 28 to the mounting member 27.

Referring to FIG. 5 in conjunction with FIG. 1 and FIG. 4 the mounting member 27 has a first flange 28*a* and a second flange 28*b*, both of which are disposed along its bottom peripheral edge protruding frontward. The first flange 28*a* is disposed to the right of the centerline of the mounting member 27. The second flange 28*b* is disposed to the left of the centerline of the mounting member 27.

Referring still to FIG. 5 the lever arm 28 has a first groove 29*a*, which is disposed to the right of the centerline of the lever arm 28 adjacent thereto, and a second groove 29*b*, which is disposed to the left of the center-line of the lever arm 28 adjacent thereto. Referring again to FIG. 5 in conjunction with FIG. 1 and FIG. 4 the movable carrier 14 has moved laterally to the left-hand side of the frame 11. The pivot pin 29 is disposed in the first groove 29*a* of the lever arm 28 so that the lever arm 28 is in its first position. The lever arm 28 also has a first spring anchor pin 30*a* and a second spring anchor pin 30*b*, which are adjacent to its first and second grooves 29*a* and 29*b*, respectively. The springs 30 are attached to the first and second anchor pins 30*a* and 30*b*.

Figure 6:
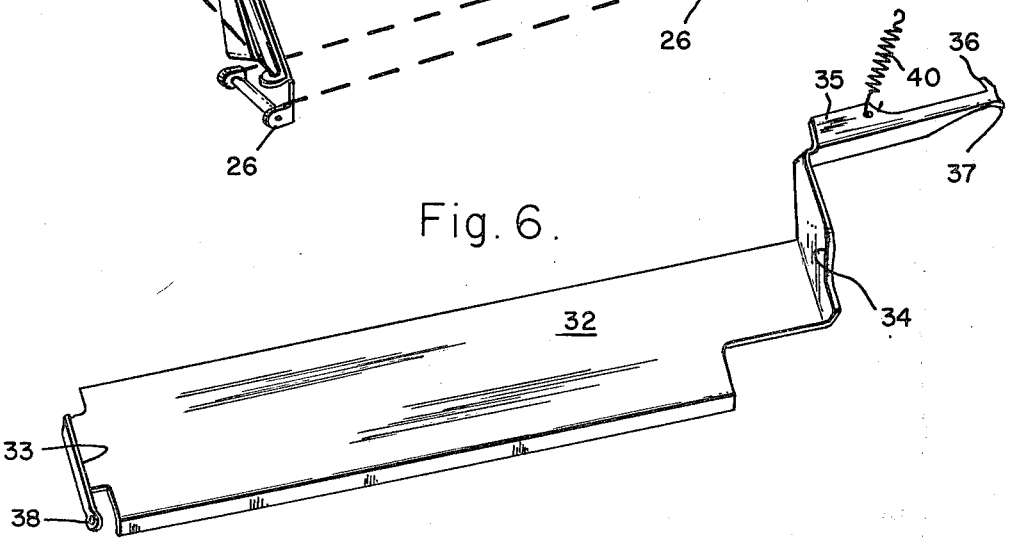
FIG. 6 is a perspective drawing of a sliding member of the inked ribbon advance and reverse mechanism of the multiple print station printing apparatus of FIG. 1.

Referring now to FIG. 6 the inked ribbon advance and reverse mechanism 20 still further yet includes a sliding member 32 which has a first flange 33 and a second flange 34. The sliding member 32 also has a pawl 35 which is fixedly coupled to its second flange 34 and which has a first tooth 36 and a second tooth 37 which is orthogonal and adjacent, but not contiguous, to the first tooth 36. The first flange 33 has a bore 38 which is disposed so that its axis is parallel to the plane of the sliding member 32, which is substantially a rectangular member. Referring to FIG. 6 in conjunction with FIG. 4 and FIG. 2 the sliding member 32 slidably moves laterally between the right-hand and left-end side plates 12 and is mechanically coupled to the left-hand side plate 12 by a guide pin 39, which is disposed orthogonally to the left-hand side plate 12 and fixedly coupled thereto. A spring 40 resiliently couples the sliding member 32 to the right-hand side plate 12. The spring 40 is disposed within a hole in the right-hand side plate 12 and is attached thereto. The spring 40 is also attached to the pawl 35 thereby resiliently coupling the sliding member 32 to the right-hand side plate 12 of the frame 11.

Referring still further to FIG. 5 in conjunction with FIG. 1 and FIG. 4 the pivot pin 29 is in the first groove 29*a* of the lever arm 28 so that when the movable carrier 14 moves toward the left the movable carrier 14 moves the mounting member 27, the pivot pin 29 and the lever arm 28 laterally toward the left. As a result of this movement the left end of the lever arm 28 contacts the first flange 33 of the sliding member 32 and begins to push the sliding member 32 toward the left. As the movable carrier 14 continues to move toward the left the movable carrier 14 causes the sliding member 32 to slide to the left. Once the movable carrier 14 has reached a left-most position and the sliding member 32 has moved laterally to its left-most position, the first bi-directional motor 16 is reversed thereby reversing the direction of travel of the movable carrier 14 and causing the lever arm 28 to move toward the right. When the right end of the lever arm 28 contacts the second flange 34 it begins to push the second flange 34 of the sliding member 32 toward the right.

Figure 7B:
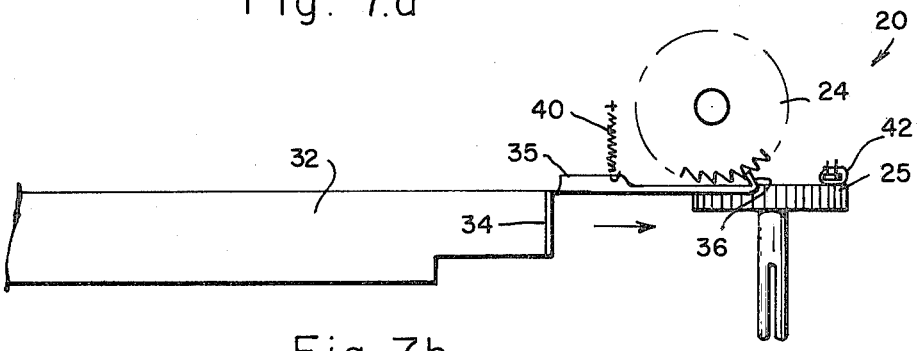

Referring now to FIG. 7*a* and FIG. 7*b* in conjunction with FIG. 4 and FIG. 6, when the movable carrier 14 has reached its right-most position, the sliding member 32 is in its neutral position wherein the spring 40 is substantially orthogonal to the moving direction of the sliding member 32. When the movable carrier 14 has reached its right-most position, the first bi-directional motor 16 is again reversed thereby reversing the direction of travel of the movable carrier 14 and causing the lever arm 28 to move toward the left. When the movable carrier 14 moves laterally back and forth, it reaches its left-most position in each moving cycle. The sliding member 32 also moves back and forth between its left-most position and its neutral position causing the inked ribbon advance and reverse mechanism 20 to operate in its first mode. When the inked ribbon advance and reverse mechanism 20 operates in its first mode, the first tooth 36 of the pawl 35 engages one of the teeth of the first ratchet wheel 24 as the left end of the lever arm 28 contacts the first flange 33 of the sliding member 32. As the lever arm 28 moves continuously to the left, the left end of the lever arm 28 pushes the first flange 33 of the sliding member 32 to the left. The pawl 35, which is fixedly coupled to the sliding member 32, is thereby moved to the left causing its first tooth 36, which has engaged one of the teeth of the first ratchet wheel 24, to pull one of the teeth of the first ratchet wheel 24 thereby turning the first ratchet wheel 24 in a clockwise direction. The first ribbon spool 22 is axially aligned and fixedly coupled to the first ratchet wheel 24 so that it also turns in a clockwise direction in order to wind onto the first ribbon spool 22 the inked ribbon 21 which the first ribbon spool 22 unwinds from the second ribbon spool 23. In the first mode of operation of the inked ribbon advance and reverse mechanism 20 the first ribbon spool 22 functions as the take-up spool and the second ribbon spool 23 functions as the supply spool.

Still referring to FIG. 7*a* and FIG. 7*b* in conjunction with FIG. 4 and FIG. 8, when the inked ribbon advance and reverse mechanism 20 is in its first mode of operation the second tooth 37 of the pawl 35 does not engage any of the teeth of the second ratchet wheel 25 as the movable carrier 14 moves laterally, back and forth, across the frame 11. When the sliding member 32 is in its neutral position the second tooth 37 of the pawl 35, although it is adjacent to the teeth of the second ratchet wheel 25, is spaced apart therefrom. When the sliding member 32 is in its first displaced position to the left the second tooth 37 of the pawl 35 is moved farther away from the teeth of the second ratchet wheel 25 than when the sliding member 32 is in its neutral position.

Referring to FIG. 4 in conjunction with FIG. 7*a* and FIG. 7*b*, the inked ribbon advance and reverse mechanism 20 still further yet includes a first tension spring 41 and a second tension spring 42. The first tension spring 41 is disposed adjacent to the circumferential edge of the first ratchet wheel 24 and is mechanically coupled to the first ratchet wheel 24 so that the first tension spring 41 impedes counter-clockwise rotation of the first ratchet wheel 24. The second tension spring 42 is disposed on the circumferential edge of the second ratchet wheel 25 and is mechanically coupled to the second ratchet wheel 25. When the first tooth 36 of the pawl 35 moves to the right as the sliding member 32 moves to the right back to its neutral position, the first tooth 36 of the pawl 35 does not cause the first ratchet wheel 24 to rotate in a counter-clockwise direction due to the frictional force applied by the first tension spring 41 whereby the first ratchet wheel 24 has been moved an incremental distance which is equal to the pawl displacement distance and an incremental angular-displacement which is equal to the pawl displacement distance divided by the radius of the first ratchet wheel 24. Furthermore the inked ribbon advance and reverse mechanism 20 has been reset so that when the movable carrier 14, so long as the inked ribbon advance and reverse mechanism is in its first mode of operation, again moves to the left it will move the first ratchet wheel 24 the same incremental distance.

Referring back to FIG. 5 in conjunction with FIG. 1, FIG. 4 and FIG. 7*a*, since the pivot pin 29 remains in the first groove 29*a* of the lever arm 28, the operation of the pawl 35 continues repetitively in its first mode until the inked ribbon 21 is completely unwound from the second ribbon spool 23. In view of the fact that each end of the inked ribbon 21 is fixedly secured to the axis of each of the corresponding ribbon spools 22 and 23 when the inked ribbon 21 has completely unwound from the second ribbon spool 23 the rotational movement of the first ribbon spool 22 and the first ratchet wheel 24 is constrained by the inked ribbon 21. Since the first tooth 36 of the pawl 35 is engaged in one of the teeth of the first ratchet wheel 24, whose rotational movement is constrained by the inked ribbon 21, the pawl 35 and the sliding member 32 are also constrained and can no longer move to the left with the movable carrier 14 and the mounting member 27. The lever arm 28 which engages the first flange 33 of the sliding member 32 whose lateral movement is constrained by the first ratchet wheel 24, also has its lateral movement constrained by the first flange 33 so that the lateral movement of the mounting member 27 to the left forces the pivot pin 29 to move from the first groove 29*a* of the lever arm 28 to the second groove 29*b* of the lever arm 28. In this operation the inked ribbon advance and reverse mechanism 20 has changed from its first mode of operation to its second mode of operation.

Referring now to FIG. 8 the inked ribbon advance and reverse mechanism 20 is now in its second mode of operation. The mounting member 27 continues to move laterally, back and forth, with the movable carrier 14 across the frame 11. Now referring to FIG. 9 in conjunction with FIG. 2 and FIG. 8 the pivot pin 29 is now in the second groove 29*b* of the lever arm 28. The right end of the lever arm 28 is now moved a greater distance to the right and therefore as the movable carrier 14 continues to move to the right it pushes the second flange 34 of the sliding member 32 further to the right thereby moving the sliding member 32 a distance, which is equal to the displacement distance, from its neutral position.

Referring now to FIG. 10*a* and FIG. 10*b* in conjunction with FIG. 6 and FIG. 8 the sliding member 32 is its second displaced position when the right end of the lever arm 28 has contacted and has pushed the second flange 34 of the sliding member 32 to the right. The sliding member 32 is in its neutral position when the left end of the lever arm 28 has contacted and has pushed the first flange 33 of the sliding member 32 back to the left. When the inked ribbon advance and reverse mechanism 20 operates in its second mode, the second tooth 37 of the pawl 35 engages one of the teeth of the second ratchet wheel 25 as the right end of the lever arm 28 contacts the second flange 34 of the sliding member 32. As the lever arm 28 moves continuously to the right the right end of the lever arm 28 pushes the second flange 34 of the sliding member 32 to the right. The pawl 35, which is fixedly coupled to the sliding member 32, is thereby moved to the right causing the second tooth 37, which has engaged one of the teeth of the second ratchet wheel 25, to push one of the teeth of the second ratchet wheel 25 thereby turning the second ratchet wheel 25 in a clockwise direction. The second ribbon spool 23 is axially aligned and fixedly coupled to the second ratchet wheel 25 so that it also turns in a clockwise direction in order to wind onto the first ribbon spool 22 the inked ribbon 21 which the first ribbon spool 22 unwinds from the second ribbon spool 23. In the second mode of operation of the inked ribbon advance and reverse mechanism 20 the first ribbon spool 22 functions as the supply spool and the second ribbon spool 23 functions as the take-up spool.

Referring to FIG. 11 in conjunction with FIG. 10 and FIG. 10*b* when the inked ribbon advance and reverse mechanism 20 is in its second mode of operation the first tooth 36 of the pawl 35 does not engage any of the teeth of the first ratchet wheel 24 as the movable carrier 14 moves laterally, back and forth, across the frame 11. When the sliding member 32 is in its neutral position the first tooth 36 of the pawl 35, although adjacent to the teeth of the first ratchet wheel 24, is spaced apart therefrom. When the sliding member 32 is in its second displaced position the first tooth 36 of the pawl 35 is moved farther away from the teeth of the first ratchet wheel 24 than when the sliding member 32 is in its neutral position.

Referring to FIG. 10*a* and FIG. 10*b* in conjunction with FIG. 8 when the movable carrier 14 has moved back to the left-most position and the left end of the lever arm 28 has contacted and pushed the first flange 33 of the sliding member 32, the sliding member 32 is moved from its second displaced position back to its neutral position. The neutral position of the sliding member 32 is a substantially mid-position of its entire movable distance of the first and second modes of operation of the inked ribbon advance and reverse mechanism 20. Referring to FIG. 10*a* and FIG. 10*b* in conjunction with FIG. 1 and FIG. 11 the second tension spring 42 impedes counter-clockwise rotation of the second ratchet wheel 25 so that when the second tooth 37 of the pawl 35 moves to the left as the sliding member 32 moves toward the left to its neutral position the second tooth 37 of the pawl 35 does not cause the second ratchet wheel 25 to rotate in a counter-clockwise direction. The second ratchet wheel 25 has been moved an incremental distance which is equal to the pawl displacement distance and an incremental angular displacement which is equal to the pawl displacement distance divided by the radius of the second ratchet wheel 25. Furthermore the inked ribbon advance and reverse mechanism 20 has been reset so that when the movable carrier 14, so long as the inked ribbon advance and reverse mechanism 20 is in its second mode of operation, again moves to the right it will move the second ratchet wheel 25 the same incremental distance.

Still referring to FIG. 10*a* and FIG. 10*b* in conjunction with FIG. 11 the second tension spring 42 provides an appropriate amount of friction to impede the counter-clockwise rotation of the second ratchet wheel 25, but the second tooth 37 of the pawl 35 also does not positively engage the teeth of the second ratchet wheel 25 as the sliding member 32 moves to the left.

Referring to FIG. 9 in conjunction with FIG. 1, FIG. 8 and FIG. 10*a* and FIG. 10*b*, since the pivot pin 29 remains in the second groove 29*b* of the lever arm 28, the operation of the pawl 35 continues repetitively in its second mode until the inked ribbon 21 is completely unwound from the first ribbon spool 22. In view of the fact that each end of the inked ribbon 21 is fixedly secured to the axis of each of the corresponding ribbon spools 22 and 23 when the inked ribbon 21 has completely unwound from the first ribbon spool 22 the rotational movement of the second ribbon spool 23 and the second ratchet wheel 25 is constrained by the inked ribbon 21. Since the second tooth 37 of the pawl 35 is engaged in one of the teeth of the second ratchet wheel 25, whose rotational movement is constrained by the inked ribbon 21, the pawl 35 and the sliding member 32 are also constrained and can no longer move to the right with the movable carrier 14 and the mounting member 27. The lever arm 28, which engages the second flange 34 of the sliding member 32 whose lateral movement is constrained by the second ratchet wheel 25, also has its lateral movement constrained by the second flange 34 so that the lateral movement of the mounting member 27 to the right forces the pivot pin 29 to move from the second groove **29*b* of the lever arm 28 to the first groove 29*a* of the lever arm 28. In this operation the inked ribbon advance and reverse mechanism 20** has changed from its second mode of operation to its first mode of operation.

Referring now to FIG. 1 in conjunction with FIG. 2 the printing apparatus 10 has three print stations. The first print station is a journal station in which a first print medium 43 is disposed adjacent to the first platen 17. When the rotatable print head 13 is in its printing alignment with the first platen 17 the first print medium 43 is disposed between the rotatable print head 13 and the first platen 17. The second print station is a receipt station in which a second print medium 44 is also disposed adjacent to the first platen 17. When the rotatable print head 13 is in its printing alignment with the first platen 17 the second print medium 44 is also disposed between the rotatable print head 13 and the first platen 17. The third print station is a slip station in which a third print medium 45 is placed on a slip table 46, which is disposed adjacent to the second platen 18. When the rotatable print head 13 is in its printing alignment with the second platen 18 the third print medium 45 is disposed between the rotatable print head 13 and the second platen 18 on the slip table 46. The printing apparatus 10 has a media guide 47. The third print medium 45 is disposed between the media guide 47 and the slip table 46.

The printing apparatus 10 also has a first optical sensor 48 and a second optical sensor 49 which are attached to the side plates 12. The movable carrier 14 has a first protruding member 50 and a second protruding member 51 which are mechanically coupled thereto and which are aligned so that they are optically coupled to the first and second optical sensors 48 and 49. The first and second optical sensors 48 and 49 provide electrical signals to a control unit for the first bi-directional motor 16.

From the foregoing it can be seen that a pawl and lever combination for use with an inked ribbon advance and reverse mechanism of a multiple print station printing apparatus has been described. Accordingly it is intended that the foregoing disclosure and showing made in the drawing shall be considered only as illustrations of the present invention. Furthermore, it should be noted that the sketches are not drawn to scale and that distances of and between the figures are not to be considered significant. The invention will be set forth with particularity in the appended claims.

What is claimed is:

1. An improved inked ribbon advance and reverse mechanism for use in a multiple print station printing apparatus, which includes a frame having a base, a first side plate and a second side plate, which are parallelly and oppositely disposed, a drive shaft horizontally disposed between said first and second side plates and rotatably journaled in said sides plates, a movable carrier mechanically coupled to said drive shaft, a print head pivotally coupled to said movable carrier and a pair of platens which are disposed parallel to said drive shaft and each having a print surface of which is in a plane which is substantially orthogonal to the other plane, comprising:

a. a first ribbon spool onto which an inked ribbon is wound;

b. a first ratchet wheel the axis of which is orthogonally disposed to said base of said frame and which is axially aligned and fixedly coupled to said first ribbon spool so that said first ribbon spool and said first ratchet wheel rotate together, said first ratchet wheel being rotatably journaled in said frame adjacent to said first side plate;

c. a second ribbon spool from which an inked ribbon is unwound;

d. a second ratchet wheel the axis of which is parallelly disposed to said base of said frame and which is axially aligned and fixedly coupled to said second ribbon spool so that said second ribbon spool and said second ratchet wheel rotate together, said second ratchet wheel being rotatably journaled in said frame adjacent to said first side plate and being disposed orthogonally adjacent, but spaced, to said first ratchet wheel;

e. a sliding member which is a first elongated member having a first flange and a second flange and which is slidably coupled to said frame so that said sliding member slides bi-directionally toward said first and second side plates along said base of said frame;

f. an elongated pawl member having a first end and a second end and which is fixedly coupled at said first end to said second flange with said pawl member and said sliding member being disposed parallel to each other, a pawl element at said second end and having a first tooth which may engage one of said teeth of said first ratchet wheel and a second tooth being disposed orthogonally adjacent, but contiguous to said first tooth which may engage one of said teeth of said second ratchet wheel;

g. a mounting member which is fixedly coupled to said movable carrier;

h. a pivot pin which is fixedly coupled to said mounting member;

i. a lever arm, which is an elongated member having a first end and a second end and a first groove and a second groove which are spaced apart from the center of said elongated member so that one of said first and second grooves may be pivotally coupled to said pivot pin in order that one of said first and second ends of said lever arm may push against one or the other of said first and second flanges of said sliding member, respectively causing said first and second ratchet wheels to rotate, respectively;

j. resiliently coupling means for resiliently coupling said lever arm to said mounting member; and k. a spring which resiliently couples said first side plate to said pawl member in order to resiliently bias said sliding member so that said sliding member is biased toward a substantially mid position of its entire movable distance.

2. An improved inked ribbon advance and reverse mechanism according to claim 1 wherein said resiliently coupling means comprises:

a. a common anchor pin fixedly coupled to said mounting member; and b. a pair of springs each of which is mechanically coupled to said common anchor pin and to one side of said lever arm.

3. An improved inked ribbon advance and reverse mechanism according to claim 1 wherein said lever arm may be forced from one of said first and second grooves to the other groove thereby reversing the direction in which said lever arm pushes said sliding member, which may move a fixed distance between said first and second side plates, in reference to said substantially mid position of its entire movable distance.

* * * * *